US005752128A

United States Patent [19]

Yamashita

[11] Patent Number: 5,752,128

[45] Date of Patent: May 12, 1998

[54] IMAGE FORMING APPARATUS WITH CONTRACT RENEWAL DEVICE

[75] Inventor: Yuji Yamashita, Osaka, Japan

[73] Assignee: Mita Industries Co. Ltd, Osaka, Japan

[21] Appl. No.: 716,886

[22] Filed: Sep. 20, 1996

[30] Foreign Application Priority Data

Sep. 28, 1995 [JP] Japan ..... 7-251380

[51] Int. Cl.[6] ..... G03G 15/00

[52] U.S. Cl. ..... 399/80; 399/11; 399/79

[58] Field of Search ..... 399/8, 9, 11, 43, 399/24, 79–81; 377/15, 16; 395/184.01

[56] References Cited

U.S. PATENT DOCUMENTS

| | | | |
|---|---|---|---|
| 5,016,059 | 5/1991 | Smeiman | 399/80 |
| 5,066,977 | 11/1991 | Yoshizuka | 399/80 |
| 5,077,582 | 12/1991 | Kravette et al. | 399/8 |
| 5,142,324 | 8/1992 | Ito | 399/79 |
| 5,206,891 | 4/1993 | Kishimoto | 377/55 |

FOREIGN PATENT DOCUMENTS

| | | |
|---|---|---|
| 06326790 | 11/1994 | Japan . |
| 7-058867 | 3/1995 | Japan . |

*Primary Examiner*—Robert Beatty

*Attorney, Agent, or Firm*—Beveridge, DeGrandi, Weilacher & Young, LLP

[57] ABSTRACT

In a copier, to execute renewal of a maintenance contract with ease and without fail, a current date is compared with a contract expiry date, and a current total count of copies is compared with a count prescribed by the contract. As long as the contract is valid, the copier is operated in a normal copying mode. Meanwhile, the difference between the current count and the contract count is monitored every time a copying operation takes place. When the contract count is exceeded, the copier displays a message indicating expiry of the contract and requesting renewal of the contract in order to notify its user that the contract count has been exceeded. The copier then switches to a restricted copying operation mode. If the user chooses to renew the contract, the user contacts a service provider, so that the service provider checks the state of the contract for the copier and performs a procedure for renewing the contract.

4 Claims, 5 Drawing Sheets

IMAGE FORMING APPARATUS WITH CONTRACT RENEWAL DEVICE

FIELD OF THE INVENTION

The present invention relates to an image forming apparatus such as an electronic photocopier, more particularly to an image forming apparatus in which conditions for the expiry of a contract are prescribed.

DESCRIPTION OF THE PRIOR ART

In an electronic photocopier, the total count of how many times image formation has been performed is counted based on the number of paper sheets that have passed through the image forming section of the photocopier. Moreover, in a copier management system in which communications control devices attached to copiers are connected through public telephone lines or other to a host computer installed at a service center managing those copiers so that the host computer can collectively manage data concerning maintenance work for the copiers, various items of operation records including total counts of image formation performed are transmitted to the host computer so that the host computer can manage operation records of every copier.

In some cases, a copier is used under a maintenance contract that prescribes a permitted image formation count or a contract expiry date. In such a case, if the contract expiry date or the permitted image formation count is registered in the above-mentioned copier management system, the communications control device of a copier, when the copier's contract expiry date has come or its count has reached the permitted count, communicates with the host computer at a service center to inform it of the expiry of the contract.

In the above-mentioned copier management system, in order for the contract expiry information to be transmitted, the communications control device attached to the copier needs to be powered all the time, and it also needs to be connected to a public telephone line all the time. However, in the case of low-segment copiers, especially home-use copiers such as are used by individuals and equipped with a communications control device, it is imagined that there is almost no user who keeps the communications control device of the copier connected to a public telephone line all the time.

Even if a system is realized in which communications control devices are connected through dedicated public telephone lines all the time as wished by a service center, such a system cannot effectively be utilized by a user who uses the copier very rarely, because the user is billed for undue telephone charges, even though transmission of the copier's operation records from the communications control device to the service center takes place only from time to time or on a once-a-month or once-a-week basis.

For this reason, most low-segment copiers are at present not equipped with a communications control device. Thus, a user of an infrequently used copier with a small count of copies produced usually has no idea as to when the permitted total count prescribed by the contract will be reached. As a result, the user often continues to use the copier even after the expiry of the contract.

As described above, the conventional system is defective because, if a user continues to use a copier without knowing the expiry of a contract, not only copiers suffer from being disadvantageously placed out of the scope of copy quality control, but also companies that offer management services for copiers or sell copiers suffer losses in their sales.

SUMMARY OF THE INVENTION

An object of the present invention is to provide an image forming apparatus which by itself recognizes the expiry of a contract in order to execute its renewal without fail, instead of equipping the image forming apparatus with a communications control device that transmits the copier's operation records to a host computer.

To achieve the above object, according to the present invention, an image forming apparatus in which conditions for renewal of a maintenance contract are prescribed is provided with a contract information managing means, a contract expiry detecting means, a code storing means, a renewal accepting means, and a display means. The contract information managing means stores conditions for renewal of the maintenance contract. The contract expiry detecting means compares operation records at a particular moment with the conditions for renewal of the maintenance contract in order to detect expiry of the contract. The code storing means stores a contract renewal code for the maintenance contract. The renewal accepting means executes renewal of the contract only when the contract renewal code is entered. The display means displays a message requesting renewal of the contract when the contract expiry detecting means has detected expiry of the contract.

According to the above described construction, when the contract expiry detecting means detects expiry of a maintenance contract for the image forming apparatus, the display means displays a message requesting renewal of the contract. The user, on recognizing the message, contacts the company with which the user is under contract, so that a serviceperson at that company enters a contract renewal code into the image forming apparatus itself. If the entered code is recognized as correct, the renewal accepting means executes renewal of the contract.

An image forming apparatus is usually equipped with an operation restricting means that places restrictions on image forming operation based on a comparison result obtained by the contract expiry detecting means. To cope with such a case, the image forming apparatus of the present invention is further equipped with an operation restriction canceling means so that, when the renewal accepting means has accepted a contract renewal code, the restrictions placed on image forming operation are canceled.

The operation restricting means may prohibit feeding a sheet of paper so that no image can be formed at all, or it may prohibit continuous feeding of sheets of paper so that only a single image can be formed in an operation. Prohibition of these operations is canceled by the restriction canceling means.

If contract renewal codes are kept fixed, they are liable to cause leakage of secret information. However, If contract renewal codes are generated by calculation based on a machine number of the image forming apparatus itself according to a predetermined function, leakage of codes can be minimized.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
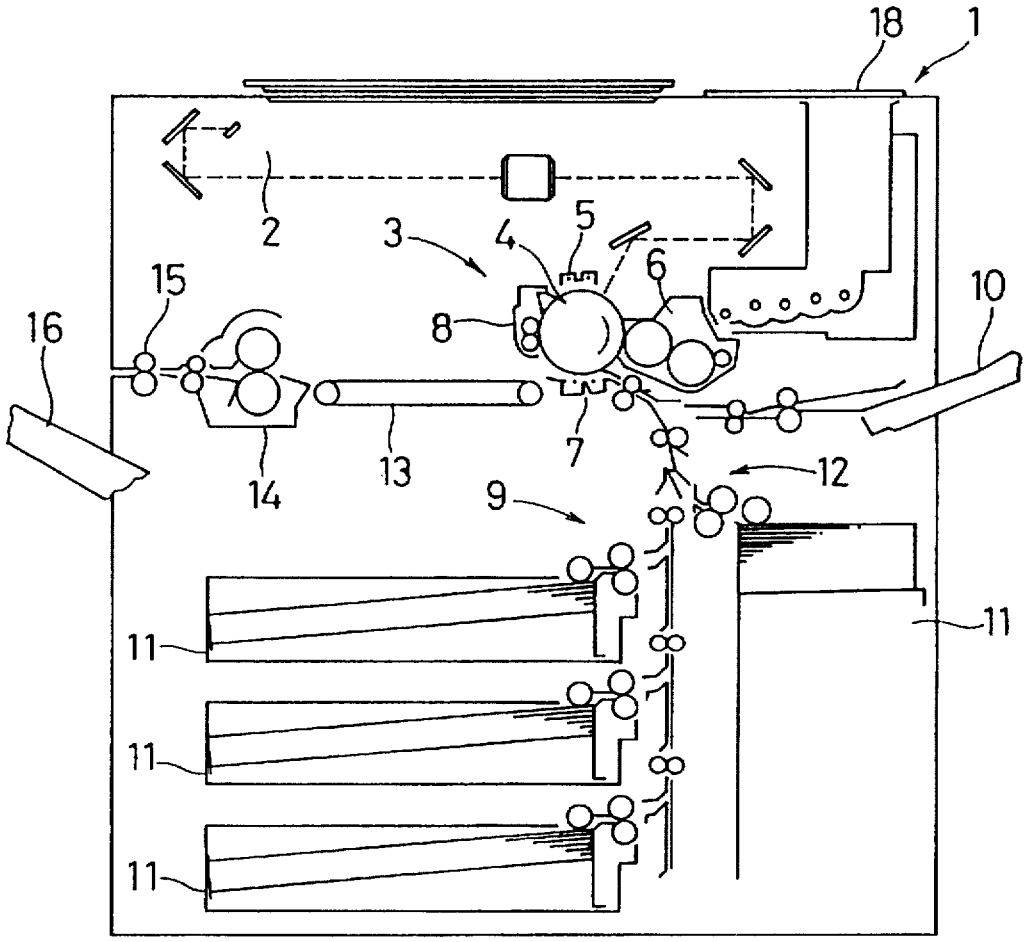
FIG. 1 is a cross-sectional view schematically showing the copier embodying the present invention.

Hereinafter, an embodiment of the present invention as applied to an electronic photocopier will be described with reference to the drawings. The copier of this embodiment allows conditions for renewal of a contract to be prescribed in itself, and is equipped with, as shown in FIG. 1, an optical system 2 fitted in the upper part of the body 1. The optical system 2 is for reading an original and comprises a light source, mirrors, lens units, and other components. In the central part of the copier body 1 is provided an image forming section 3 for forming an image with toner based on the read original. The image forming section 3 has a photosensitive drum 4, on the surface of which an electrostatic latent image is formed. Arranged around the photosensitive drum 4 are a main charger 5, a developing unit 6, a separation charger 7, and a cleaning unit 8.

In the lower part of the copier body 1 is provided a paper feed section 9. The paper feed section 9 comprises a bypass table 10 that is disposed in the right-hand part of the copier body 1 shown in FIG. 1, a plurality of paper feed cassettes 11 arranged vertically in the lower part of the copier body 1, and a paper transfer unit 12 for transferring paper sheets stocked in the bypass table 10 or paper feed cassettes 11 to the image forming section 3. Arranged on the downstream side of the image forming section 3 along the paper transfer direction are a paper ejecting conveyor 13 for conveying paper sheets to the left-hand part of the copier shown in FIG. 1, a fixing unit 14 for fixing a toner image on paper by fusion, ejecting rollers 15 for ejecting paper sheets after image fixation, and an ejected-paper tray 16 for stocking ejected paper sheets.

Figure 2:
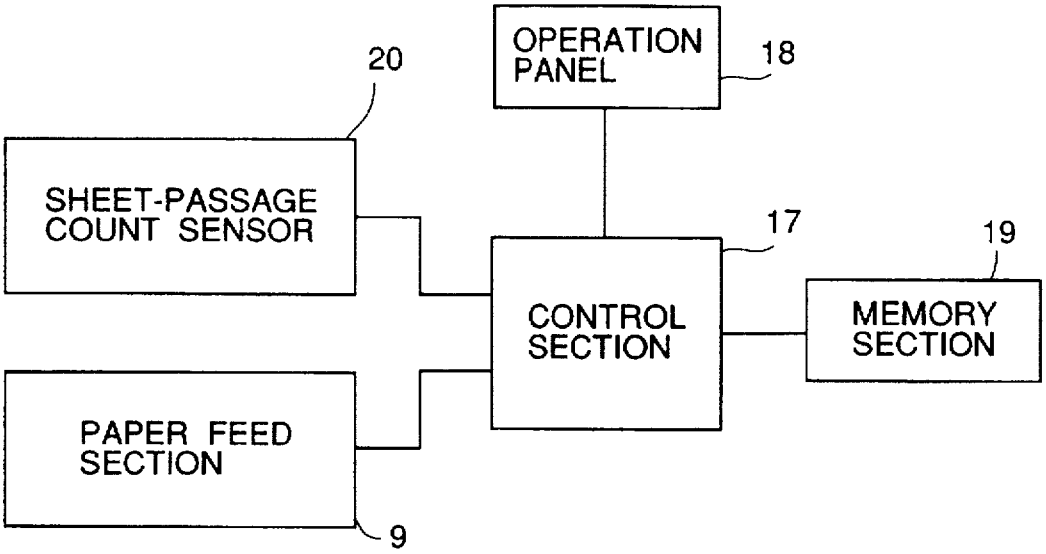
FIG. 2 is a block diagram showing the control system of the copier.

The copier body 1 is further equipped with a control section 17 shown in FIG. 2. The control section 17 is constructed as a microcomputer system including a CPU, a RAM, a ROM, a variety of drivers, and a variety of I/O ports, and an operation panel 18 is connected to it. As shown in FIG. 1, the operation panel 18 is disposed on the upper surface of the copier body 1, and includes an input keypad section and a display section serving as a display means composed of liquid crystal display devices, light emitting diodes, or other.

Figure 3:
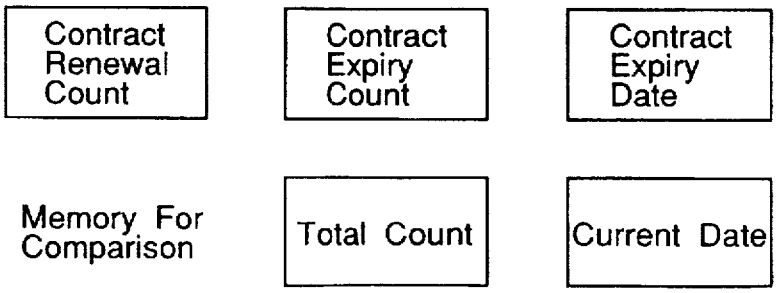
FIG. 3 is a diagram showing data items stored in the memory of the memory section.

Connected to the control section 17 is a memory section 19 for storing various items of operation records. As shown in FIG. 3, the memory section 19 stores, on the one hand, the three basic items of data concerning a maintenance contract, that is, the count of how many times the contract has been renewed, the count of copies which is permitted under the contract and at which the contract expires, and the contract expiry date. On the other hand, the memory section 19 also stores a total count of copies produced on the copier body 1, and the current date, in order to compare therewith the above-mentioned basic items of data. Depending on the state of this memory section 19, that is, depending on whether the contract is still valid or has already expired, restrictions are placed on copying operation by establishing, for example, a copying-inhibited mode or a single-copy-permitted mode, both of which do not permit normal copying operation.

Also connected to the control section 17 are a sheet-passage count sensor 20 for counting how many images have been formed, and a paper feed section 9 for feeding paper from paper feed cassettes 11. Actually, a plurality of sheet-passage count sensors 20 are arranged in appropriate positions along the paper feed path from each paper feed cassette 11 through the image forming section 3 and the fixing unit 14 to the ejected-paper tray 16, so that, when a correct passage of a paper sheet is detected, the total count stored in the memory section 19 is incremented.

Figure 4:
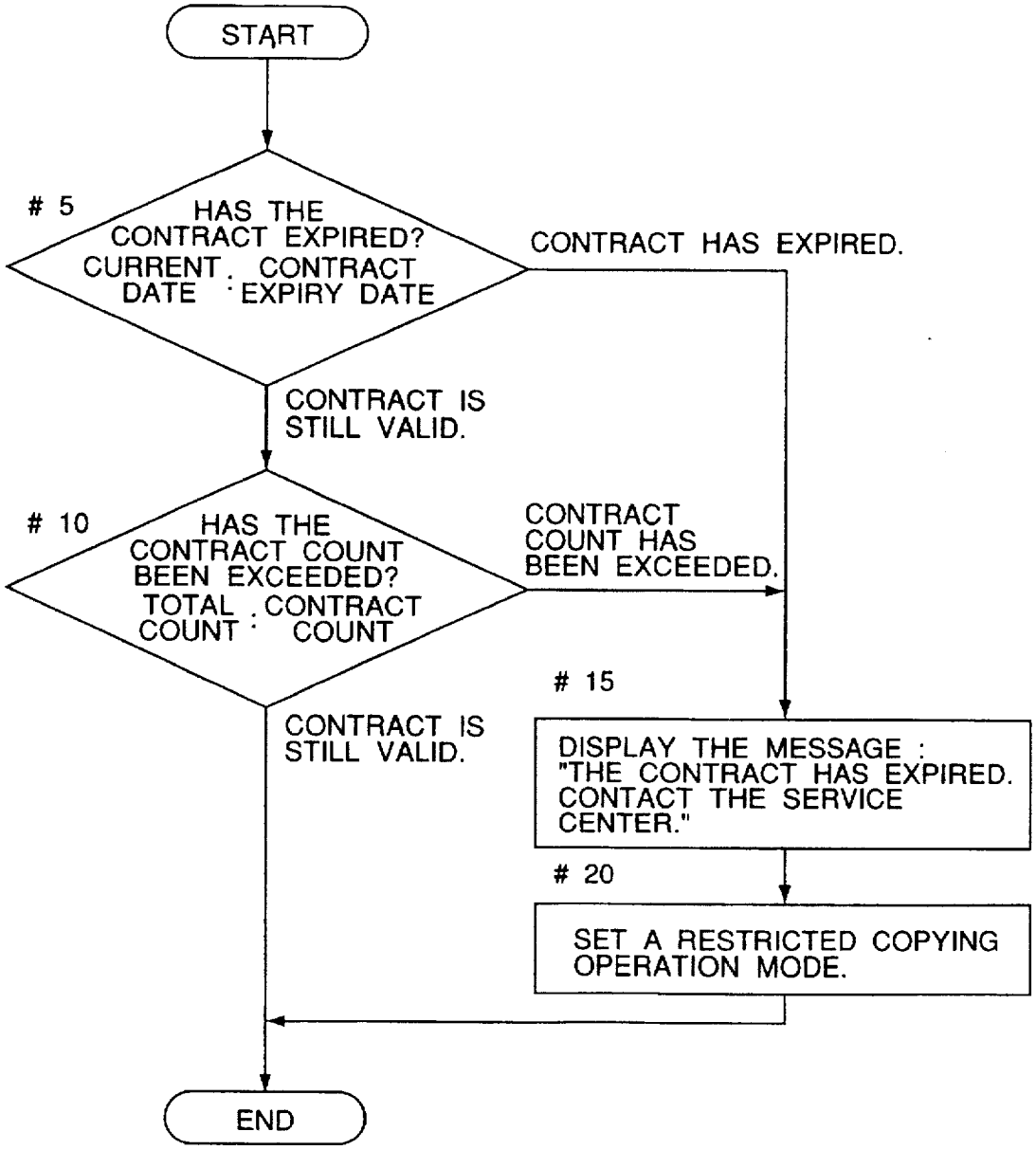
FIG. 4 is a flow chart showing the contract expiry judging operation that is performed by the control unit every time copying operation takes place.

FIG. 4 shows the contract expiry judging operation that is performed by the control section 17 of the copier every time copying operation takes place. When power is switched on, the copier initializes various parameters, and judges the current operation mode. Here, first, in step #5, the current date is compared with the contract expiry date. If the contract is judged to be still valid, then, in step #10, the current total count of copies produced is compared with the count prescribed by the maintenance contract. If the count is judged to be within the prescribed count, the normal copying mode is established.

In the normal copying mode, the control section 17 is set as required by this mode, and waits for an instruction for copying operation to be given through the input keypad section of the operation panel 18. When an instruction for copying operation is received, the control section 17 performs normal copying just as instructed through the input keypad section of the operation panel 18. Here, too, the contract expiry judging operation proceeds as follows. In step #10, the difference between the count of copies produced by the sheet-passage count sensor 20 which counts every time a copying operation takes place, i.e. the count of use of the copier, and the count prescribed by the contract that is stored in the memory section is monitored. If the count prescribed by the contract is exceeded, the contract is judged to have expired, and the operation flow proceeds to step #15.

In step #15, the liquid crystal display section of the operation panel 18 displays a message indicating expiry of the contract and requesting renewal of the contract, like "The contract has expired. Contact the service center", in order to notify the user that the count of copies prescribed by the contract has been exceeded. Instead of such a message, an LED may as well be turned on to prompt the user to contact the service center.

When the contract has expired, the control section 17 is set for one of restricted copying operation modes, in step #20. There are two restricted copying operation modes: a copying-inhibited mode and a single-copy-permitted mode. The copying-inhibited mode takes effect by, for example, inhibiting the control section 17 from outputting instructions related to paper feeding operation to the paper feed section 9. The single-copy-permitted mode prohibits the operation in which a plurality of sheets of paper are continuously fed to the image forming section 3 and the image of an original is formed on each sheet of paper. This mode takes effect by, for example, inhibiting the control section 17 from outputting instructions related to continuous paper feeding operation from the control section 17 to the paper feed section 9.

Even when, in step #5, the contract is judged to have expired, the operation flow proceeds to step #15, where a message indicating the expiry of the contract is displayed, and then, in step #20, one of the restricted copying operation mode is established. Once the message indicating the expiry of the contract is displayed, copying operation cannot be performed freely because of the restricted copying operation mode thus established, unless the user enters a new contract code. If the user chooses to renew the contract, the user has to contact the service center, according to the message displayed. When contacted by the user, the service center confirms the state of the contract, and executes a procedure for renewing the contract.

Figure 5:
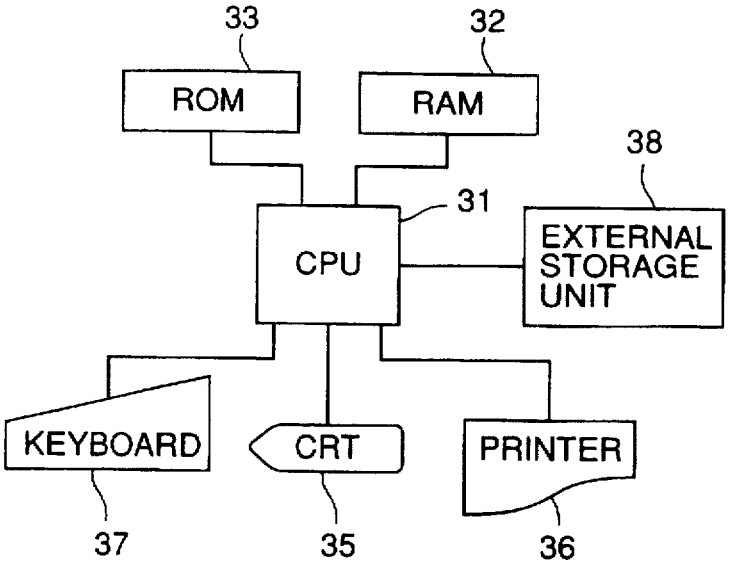
FIG. 5 is a block diagram showing the construction of a host computer.

At the service center, a host computer is installed. The host computer collectively manages a number of copiers, and is provided with, as shown in FIG. 5, a CPU 31, and a RAM 32 and a ROM 33 that are connected to the CPU 31. Also connected to the CPU 31 are a CRT 35 for display, a printer 36 for printing, a keyboard 37 for data entry, an external storage unit 38, and others. The host computer calculates a new contract code based on how many times the contract has been renewed and based on the contract period or contract count, and displays the resulting contract code. The host computer then notifies the user of the contract code, and, when the contract code is entered according to contract code entry simulation, the contract is renewed, allowing normal copying operation again.

Contract codes may be stored beforehand in the ROM of the control section 17 of a copier so that a different contract code is assigned every time the contract is renewed. In this case, however, the contract codes need to be fixed numerical values, which are difficult to keep in sufficient secrecy. One way to secure sufficient secrecy of contract codes is to use a formula that calculates a contract code based on how many times the contract has been renewed and based on the machine number unique to a copier.

For example, the following formula (1) is used to calculate a contract renewal code within a copier:

$$[\text{Renewal Code}] = ([\text{Last Two Digits of Machine Number}] + [\text{Contract Renewal Count}] \times 2) \times 3 \quad (1)$$

Calculation according to this formula may be performed on the host computer at the service center, or may be performed with a hand-held terminal carried by a serviceperson. In addition, the following formula (2) is used on the host computer at the service center to calculate a contract renewal code based on, in addition to the contract renewal count and the machine number, the count of copies prescribed by the contract and the contract period as expressed in months:

$$[\text{Renewal Code}] = ([\text{Last Two Digits of Machine Number}] + [\text{Contract Renewal Count}] \times 2) \times 3 \times 10000 + [\text{Contract Count}] + 1000 \times 100 + [\text{Contract Period (months)}] \times 1 \quad (2)$$

Figure 6:
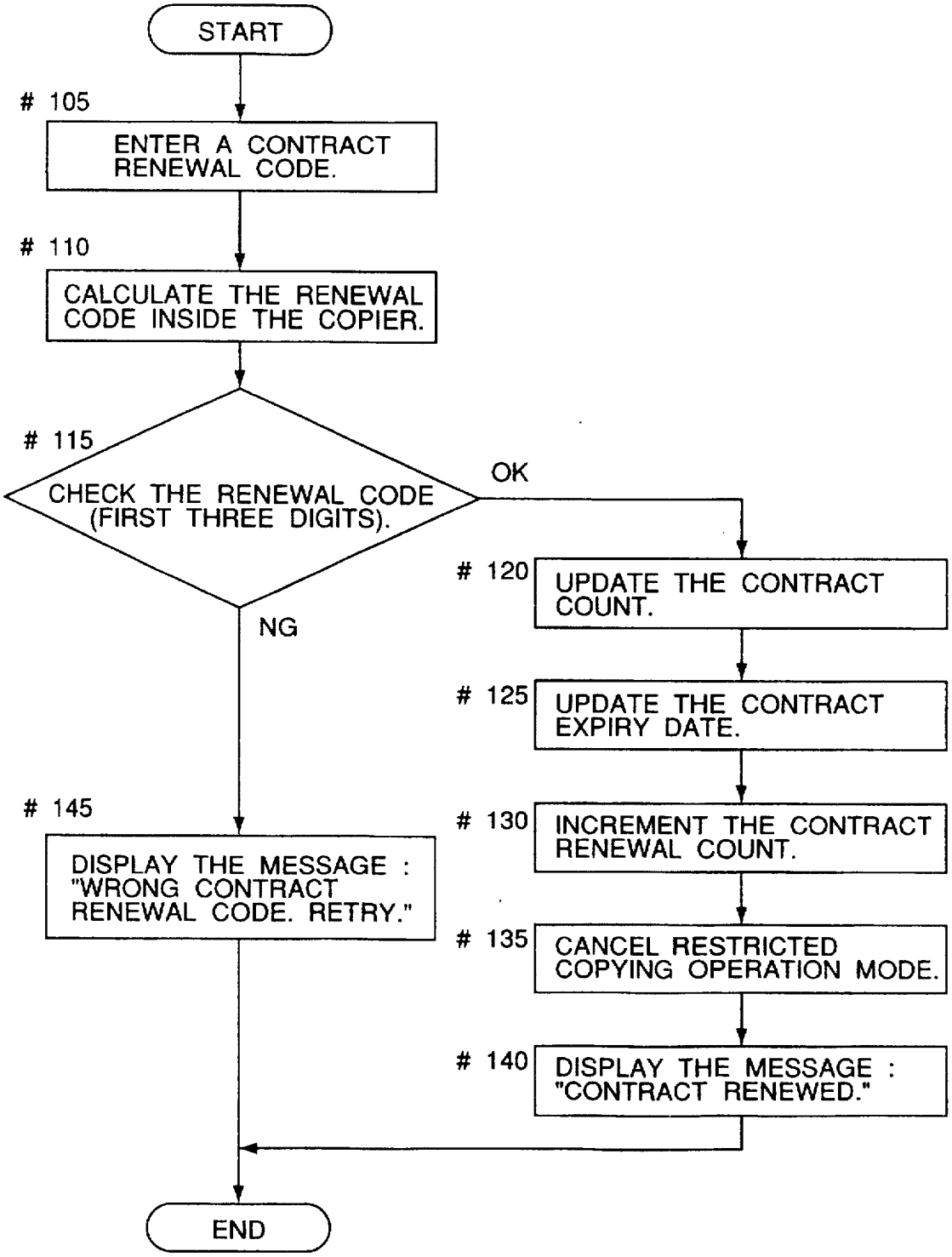
FIG. 6 is a flow chart showing the operation when a contract code is entered according to the contract code entry simulation by the host computer.

FIG. 6 shows the operation performed when a contact code is entered according to the contract code entry simulation by the copier. First, in step #105, a contract renewal code that is calculated according to the formula (2) above is entered, and then, in step #110, a renewal code within a copier is calculated according to the formula (1) above. Next, in step #115, the first three digits of the renewal code calculated by the host computer is checked against the renewal code registered in the copier, in order to verify the contract code.

If the two values disagree with each other, the operation flow proceeds to step #145, where a message like "Wrong contract renewal code. Retry" is displayed on the operation panel 18. When this error message is displayed, it is necessary to start the operation again at step #105 after performing the calculation and others. By contrast, if the two values agree with each other in step #115, the count of copies prescribed by the contract is updated in step #120, the contract expiry date is updated in step #125, the contract renewal count is incremented by one in step #130, the restricted copying operation mode is canceled in step #135, and then, in step #140, a message like "Contract Renewed" is displayed on the operation panel 18.

As an example of the above described process, a description will be given below as to the case where a copier having a machine number 1234567 undergoes contract renewal for the third time. Suppose that the count of copies prescribed by the contract is 25,000 copies, and that no condition is prescribed as to the contract period. Since the last two digits of the machine number is "67", and the contract renewal count is 3, the renewal code inside the copier is calculated, according to the formula (1), as $$[\text{Renewal Code Inside the Copier}]=(67+3\times2)\times3=219$$

This result of calculation of the renewal code inside the copier is compared with the code entered according to the contract code entry simulation.

In this example, the contract renewal code on the host computer is calculated, according to the formula (2), as $$[\text{Contract Renewal Code on the Host Computer}]=2{,}192{,}500$$

Accordingly, the first three digits of these two codes agree with each other. Based on this agreement, the contract renewal code entered this time is judged to be correct, with the result that the contract period and other settings are updated, so that normal copying operation as permitted while the contract is valid can be performed. During the contract renewal process, the sum of the current total count and the value of 25,000 is registered as the contract expiry count shown in FIG. 3. In this case, since the contract does not prescribe no condition as to the contract period, the expiry date is left blank. A blank here indicates that the expiry of the contract is not determined based on the contract period.

Note that the present invention can be applied not only to copiers, but also to other types of image forming apparatus such as laser printers, facsimile machines, etc.

As described above, according to the present invention, when expiry of a maintenance contract for an image forming apparatus is detected, a message is displayed to prompt its user to renew the contract. The user, on recognizing the message, contacts the company with which the user is under contract, so that a serviceperson at that company enters a contract renewal code into the image forming apparatus itself. If the entered code is recognized as correct, renewal of the contract is executed. Thus, unlike a conventional system in which renewal of a contract is executed with the help of a communications control device, it is needless to install a communications control device.

Accordingly, when applied to low-segment image forming apparatuses, especially to home-use copiers such as are used by individuals and conventionally equipped with a communications control device, the present invention, although it completely eliminates the costs required to install communications control devices and to use telephone lines, allows the apparatus to notify its user of expiry of a contract as soon as the contract has expired, thereby enabling the user to contact a maintenance provider. Thus, the present invention alleviates duties required on both the user's and the maintenance provider's part, and also minimizes disadvantage and inconvenience on the user's part as well as losses in sales on the service provider's part. In addition, the service center can recognize expiry of a contract without fail.

Moreover, according to the present invention, it is also possible to restrict image forming operation as soon as expiry of a contract is detected, and to cancel restrictions placed on image forming operation as soon as a contract renewal code is accepted. Thus, the present invention not only reduces losses in sales on the service provider's part, but also minimizes disadvantage due to expiry of a contract on the user's part, because a serviceperson simply needs to operate a terminal of a host computer to register the contract renewal code into the image forming apparatus in order to allow the user to use the image forming apparatus continuously again.

Furthermore, according to the present invention, contract renewal codes are generated by calculation based on a machine number of the image forming apparatus itself according to a predetermined function. Thus, the present invention minimizes leakage of secret information, which is often caused by the use of fixed codes.

Obviously, many modifications and variations of the present invention are possible in light of the above teachings. It is therefore to be understood that within the scope of the appended claims, the invention may be practiced other than as specifically described.

What is claimed is:

1. An image forming apparatus in which conditions for renewal of a maintenance contract are prescribed, comprising:

a contract information managing means for storing conditions for renewal of said maintenance contract;

a contract expiry detecting means for comparing operation records at a particular moment with the conditions for renewal of said maintenance contract in order to detect expiry of the contract;

a code storing means for storing a contract renewal code for the maintenance contract;

a renewal accepting means for executing renewal of the contract only when said contract renewal code is entered; and a display means for displaying a message requesting renewal of the contract when said contract expiry detecting means has detected expiry of the contract;

wherein contract renewal codes are generated by calculation based on a machine number of the imagine forming apparatus itself according to a predetermined function.

2. An image forming apparatus as claimed in claim 1, further comprising:

an operation restricting means for placing restrictions on image forming operation based on a comparison result obtained by the contract expiry detecting means; and an operation restriction canceling means for canceling said restrictions placed on image forming operation when the renewal accepting means has accepted a contract renewal code.

3. An image forming apparatus as claimed in claim 2, wherein said operation restricting means prohibits feeding of a sheet of paper on which an image is to be formed.

4. An image forming apparatus as claimed in claim 2, wherein said operation restricting means prohibits continuous feeding of a plurality of sheets of paper on which a same image is to be formed.

* * * * *